US009248359B2

(12) United States Patent
Marroquin et al.

(10) Patent No.: US 9,248,359 B2
(45) Date of Patent: Feb. 2, 2016

(54) SKATE AND SNOWBOARD TRAINING AID

(76) Inventors: Miguel J. Marroquin, Yountville, CA (US); Joshua Donald Wheeler, Yountville, CA (US)

( * ) Notice: Subject to any disclaimer, the term of this patent is extended or adjusted under 35 U.S.C. 154(b) by 1043 days.

(21) Appl. No.: 13/360,502

(22) Filed: Jan. 27, 2012

(65) Prior Publication Data

US 2013/0196299 A1 Aug. 1, 2013

(51) Int. Cl.

| | |
|---|---|
| ***A63B 69/00*** | (2006.01) |
| ***A63B 69/18*** | (2006.01) |
| ***A63C 17/26*** | (2006.01) |
| *A63C 17/01* | (2006.01) |

(52) U.S. Cl.

CPC ..... *A63B 69/0057* (2013.01); *A63B 69/0093* (2013.01); *A63C 17/265* (2013.01); *A63C 17/01* (2013.01)

(58) Field of Classification Search

CPC ..... G09B 19/0038; A63B 69/0093

USPC ..... 434/247, 253; D21/765, 766

See application file for complete search history.

(56) References Cited

U.S. PATENT DOCUMENTS

| | | | | |
|---|---|---|---|---|
| 4,887,825 | A * | 12/1989 | Allen et al. | 280/87.042 |
| 6,935,645 | B1 * | 8/2005 | Fuhrmeister | 280/87.042 |
| D530,385 | S * | 10/2006 | Ghassedi | D21/765 |
| 2004/0195795 | A1 * | 10/2004 | Huang | 280/87.042 |
| 2011/0291375 | A1 * | 12/2011 | Lawson | 280/87.042 |

* cited by examiner

*Primary Examiner* — Sam Yao
*Assistant Examiner* — Peter J Alley

(57) ABSTRACT

A skate and snowboard training aid that is to be held in the rider's hand when the rider is performing aerial maneuvers using the skateboard or snowboard. The preferred embodiment of the skate and snowboard training aid has a main mounting strap which is to be wrappable transversely about the skateboard platform. A swivel joint is connected to the main mounting strap. A length adjusting strap assembly is connected to the swivel joint. A handle-strap assembly connects to the swivel mechanism with this handle-strap assembly terminating in a cylindrical handle at its free end.

10 Claims, 8 Drawing Sheets

SKATE AND SNOWBOARD TRAINING AID

FIELD OF THE INVENTION

The present invention relates generally to an elastic band accessory that can be strapped onto any skateboard or snowboard. More specifically, the present invention is used as a training aid for users to perform ground tricks and aerial maneuvers.

BACKGROUND OF THE INVENTION

Traditionally, for snowboarders and skateboarders to learn aerial maneuvers, many attempts of trial and error are made until they are able to perform the desired maneuver. However, due to the multiple attempts in practicing a certain maneuver, there is a possibility an error can lead to injury. The present invention aims to decrease this possibility of injury by introducing an elastic strap that can be strapped onto a skateboard or snowboard. The present invention provides users with a handle to maintain stability for increased safety. Much like training wheels for a bike, the present invention will work in a similar fashion helping the rider maintain their center of gravity, accelerating the skill level of the rider, and increase their confidence while attempting the next trick.

One of the many differences in what makes the present invention unique from other prior art are their duel use for both skateboards and snowboards, not just one or the other. There are many individuals who skateboard and also snowboard in various regions in the United States and around the world. This present invention's purpose is to address the needs of this international market. The design of the present invention as a single piece of solid industrial rubber, with its swiveled handle at the top, split and detachable bottom clip that can be removed with ease, provides the user with unmatched stability and balance when skateboarding, or snowboarding when used in conjunction with a snowboard attachment, at high speeds downhill. The inherent spirit of the product name, "The Ollie Strap", also signifies its difference with other prior art which places sole emphasis on performing aerial tricks on skateboard ramps. An "ollie" is a well understood ground trick, performed when its user lifts the skateboard off the ground while stationary on the skateboard. As such the "The Ollie Strap" also functions as a training set for ground tricks, not just aerial maneuvers, assisting new users with increased balance and stability. "The Ollie Strap" when used in conjunction with the "Extreme Air" attachment also provides the same function for use on a snowboard.

SUMMARY OF THE INVENTION

It is an aspect of the present invention to provide a skateboard and snowboard training aid designed to be attached to a skateboard which utilizes a main mounting strap which is to be strapped transversely across the skateboard deck and secured via quick release buckle. A swivel connection serves as the flexible connection between the user-gripped handle and the mounting strap. The handle is to be tightly gripped in the rider's hand while riding. An upward pulling force is to be applied to the present invention when the rider is performing an ollie to hold the deck of the skateboard against the rider's feet.

It is a further aspect of the present invention to provide a skateboard and snowboard training aid that includes a main mounting strap, a handle, and a swivel connection. The handle being attached to the main mounting strap via the swivel connection. The swivel connection includes a plurality of screws, spacers, and washers. One end of main mounting strap is to be mounted on a skateboard deck and secured via quick release buckle connected to the swivel connection.

A further aspect of the present invention is to attach a snowboard attachment to the ends of mounting strap. The snowboard attachment allows the user to use the present invention with a snowboard the same way the invention is used with a skateboard.

DETAIL DESCRIPTIONS OF THE INVENTION

All illustrations of the drawings are for the purpose of describing selected versions of the present invention and are not intended to limit the scope of the present invention.

The present invention is an elastic product designed to strap onto any skateboard or snowboard, aiding riders regardless of skill level, to "catch" increased air and balance when doing tricks. As the rider holds onto the present invention while skateboarding or snowboarding, its elasticity and stored energy helps the rider jump or "Ollie" higher and further safely with increased balance. Much like training wheels for a bike, the present invention will work in a similar fashion to help the rider maintain their center of gravity, accelerate the skill level of the rider, and increase their confidence while attempting the next trick. When on a snowboard, an attachment is removably attached in conjunction with the present invention. A snowboard rider will be able to hoist themselves up better when stuck in the snow. This product is for beginners who want to learn how to skateboard and/or snowboard faster and for a novice who just wants to catch more air and do more tricks.

Figure 1:
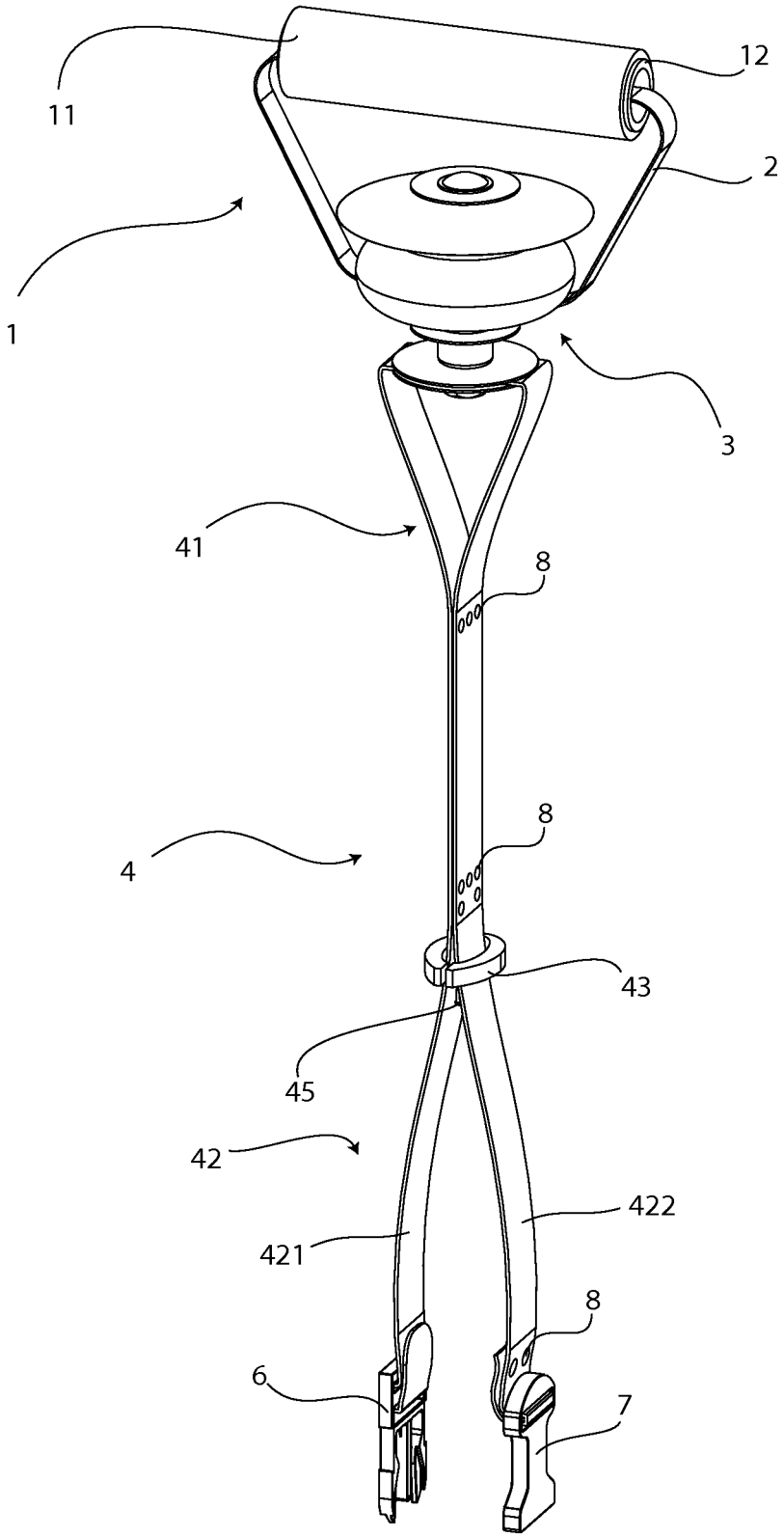
FIG. 1 is a perspective view of the present invention.
Figure 7:
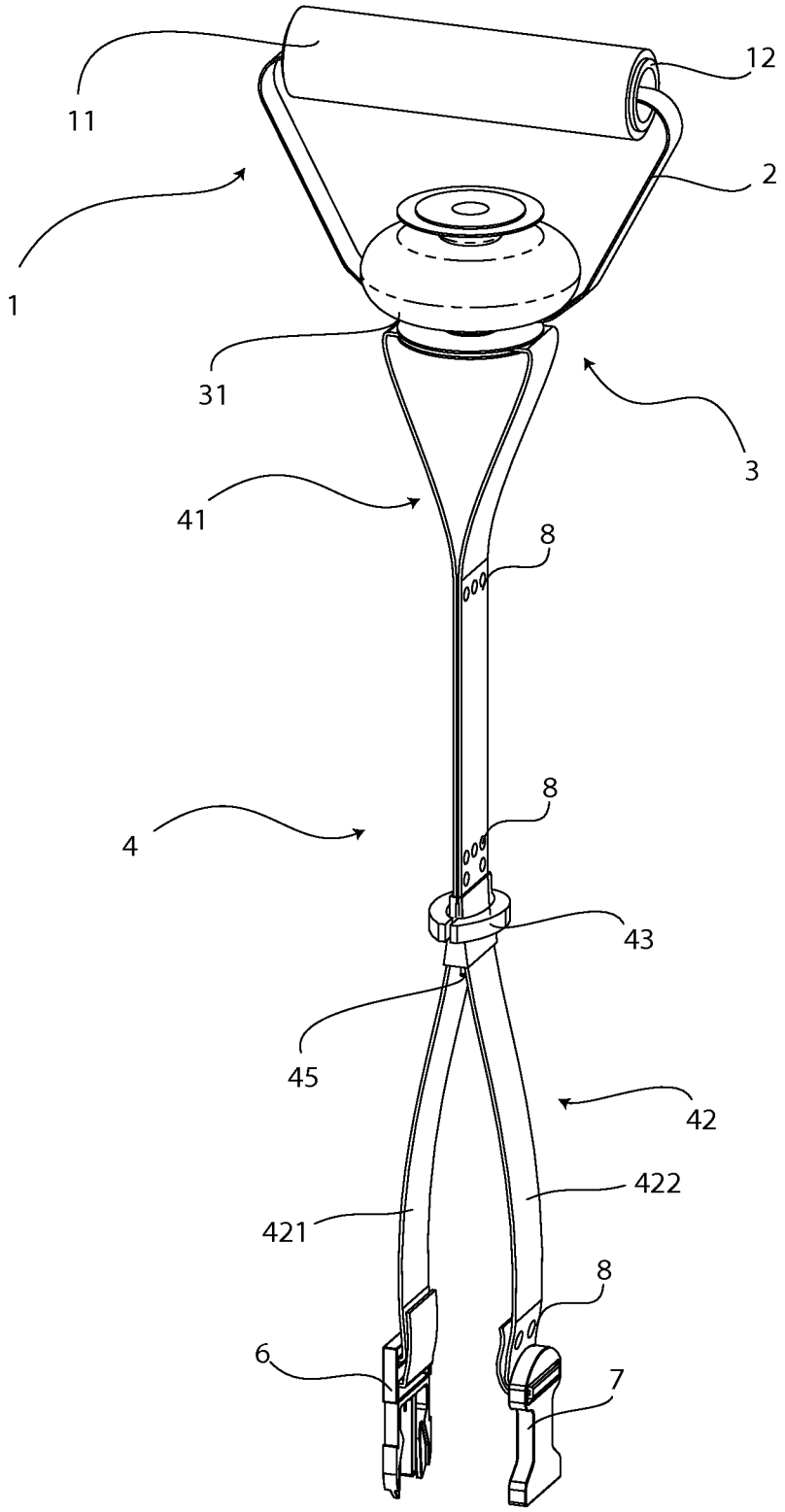
FIG. 7 is a perspective view of an alternate embodiment.
Figure 8:
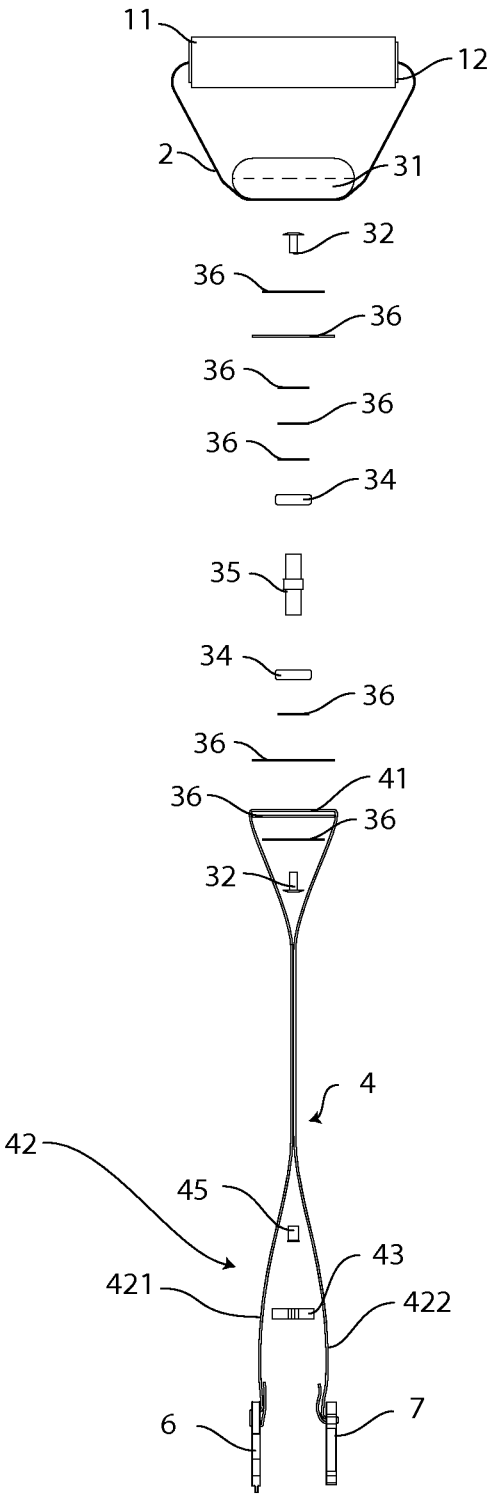
FIG. 8 is a front elevational exploded view of the alternate embodiment.

In reference to FIG. 1 the preferred embodiment of the present invention is shown. A handle 1, a swivel connection 3, and a main mounting strap 4 are the major components of the invention. The handle 1 further comprises a rubber grip 11 and a plastic tube 12. The rubber grip 11 provides the user with no-slip gripping for a more stable experience and is placed around the plastic tube 12. The plastic tube 12 provides a cylindrical structure for the handle 1. A handle strap 2, threaded through the plastic tube 12 provides a connection between the handle 1 and the swivel connection 3. And in reference to FIGS. 7 and 8 the swivel connection 3 comprises a wheel 31, a plurality of screws 32, a plurality of bearings 34, a coupling 35, and a plurality of washers 36. The plurality of washers 36 maybe made of metal or rubber materials depending on the user. From the figure, starting from the screw 32, the assembly of the swivel connection is arranged as this: a screw, a 1.5"×⅜" metal washer, a 2"×⅜" metal washer, a ¾"×⅜" rubber washer, a ¾"×⅜" metal washer, another ¾"×⅜" metal washer, one more ¾"×⅜" metal washer, a ⅞"×⅜"×¼" thick bearing, a coupling, another ⅞"×⅜"×¼" thick bearing, a ¾"×⅜" rubber washer, a 2"×⅜" metal washer, the main mounting strap, another 2"×⅜" metal washer, a 1.5"×⅜" metal washer, and another screw. The list of components described in the swivel connection 3 does not contain the wheel 31. The swivel connection 3 provides a flexible connection between the handle 1 and the main mounting strap 4 that allows them to twist against each other without damaging the components.

The main mounting strap 4 further comprises a looped end 41, a forked end 42, a securing band 43, a cap coupling 45, a plurality of pop rivets 8, a male fastening end 6, and a female fastening end 7. The forked end 42 further comprises a left end 421 and a right end 422. The main mounting strap 4 is a modified length of material. The looped end 41 is formed by folding the material in half and using the pop rivets 8 to secure the main mounting strap 4 to itself a various locations. The forked end 42 is formed by free ends and the pop rivets 8. The space between the area created by the free ends and the pop rivets 8, where the forked end 42 just begins to form is where the cap coupling 45 is positioned. The cap coupling 45 provides structural integrity for the forked end 42, ensuring the left end 421 and right end 422 to not twist and tangle. The securing band 43 is wrapped around the base of the forked end with the cap coupling 45 in between the left end 421 and right end 422. The male fastening end is attached to the left end of the forked end and secured by the pop rivets. The female fastening end 6 is attached to the right end 422 of the forked end 42 and also secured by the pop rivets 8. The looped end 41 is sandwiched between the 2"×⅜" metal washers of the swivel connection 3 to complete the present invention.

To gain a better understanding of the present invention, the operation of the skate and snowboard training aid is described. The user straps the forked end 42 and fastens the male fastening end 6 and female fastening end 7 around a skateboard. The user grips the handle of the invention while riding on the skateboard. When the user wants to perform or practice an ollie, the user jumps and at the same time exerts an upward pulling force on the handle 1, pulling the skateboard up with user. If done correctly, the upper surface of the skateboard should maintain contact with the soles of the user's shoes. The handle also provides an object for the user to grip onto with their hand(s). The use of the present invention should lead to the user's improvement in aerial maneuvers on skateboards.

Figure 4:
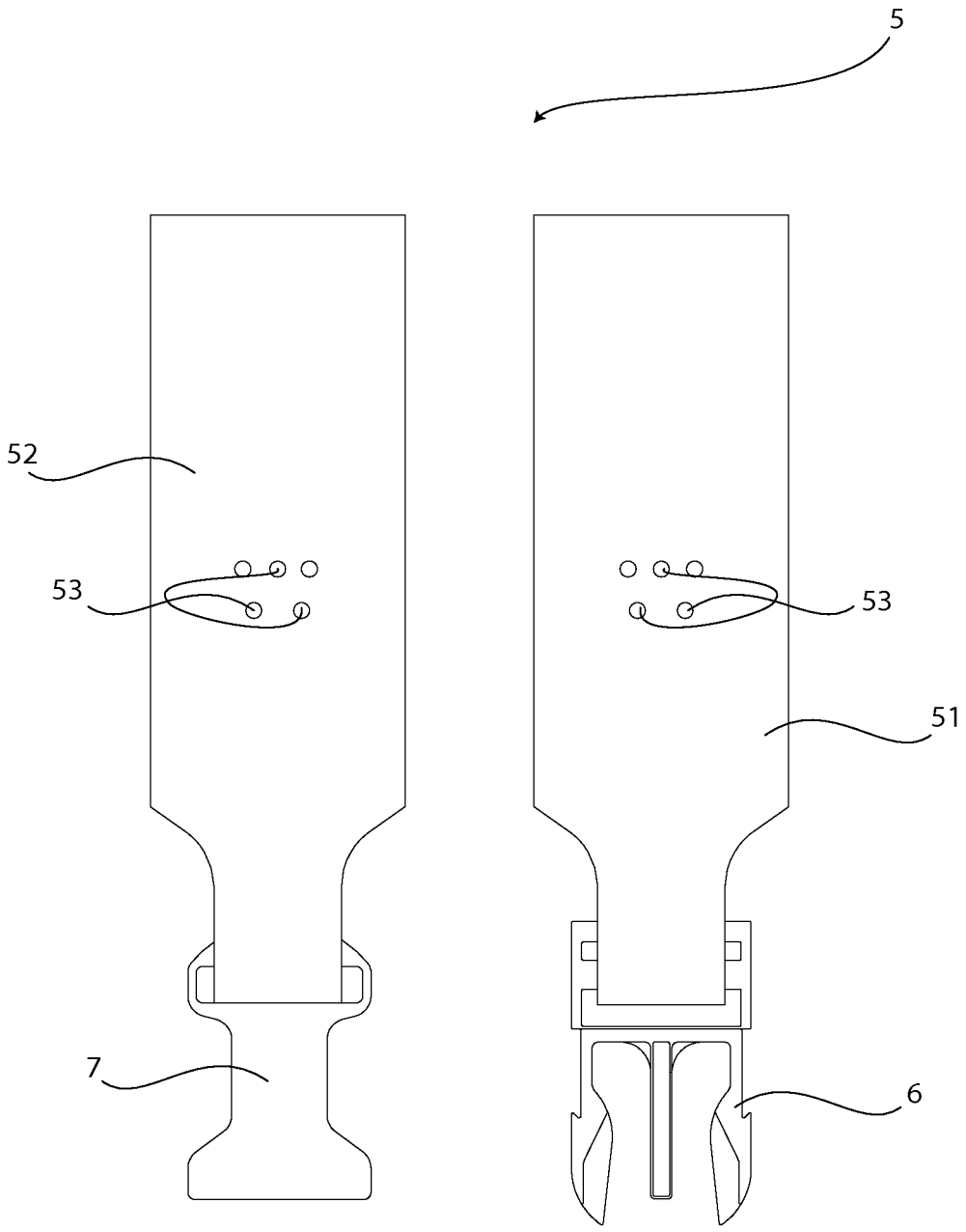
FIG. 4 is a front elevational view of the present invention with the snowboard-ready attachments attached.
Figure 5:
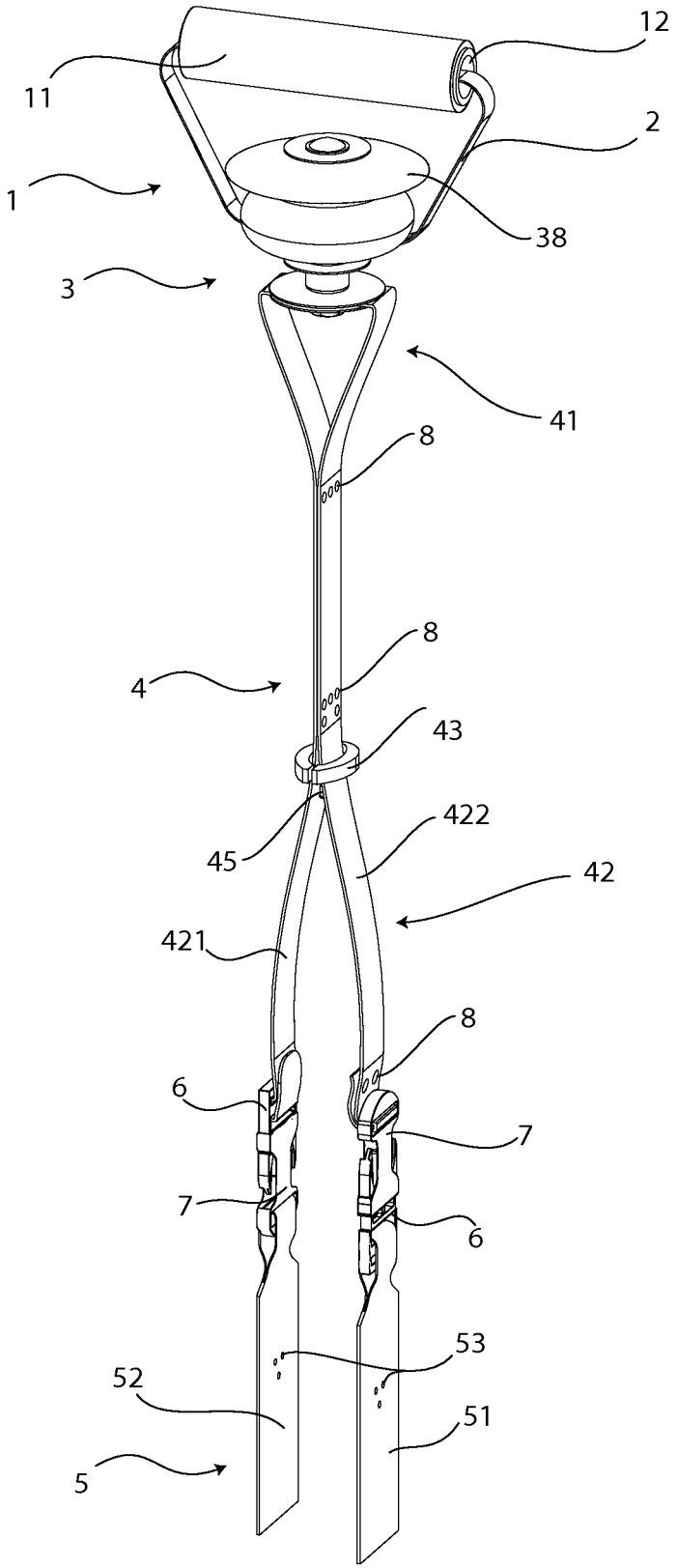
FIG. 5 is a perspective view of the present invention with the snowboard-ready attachments attached.
Figure 6:
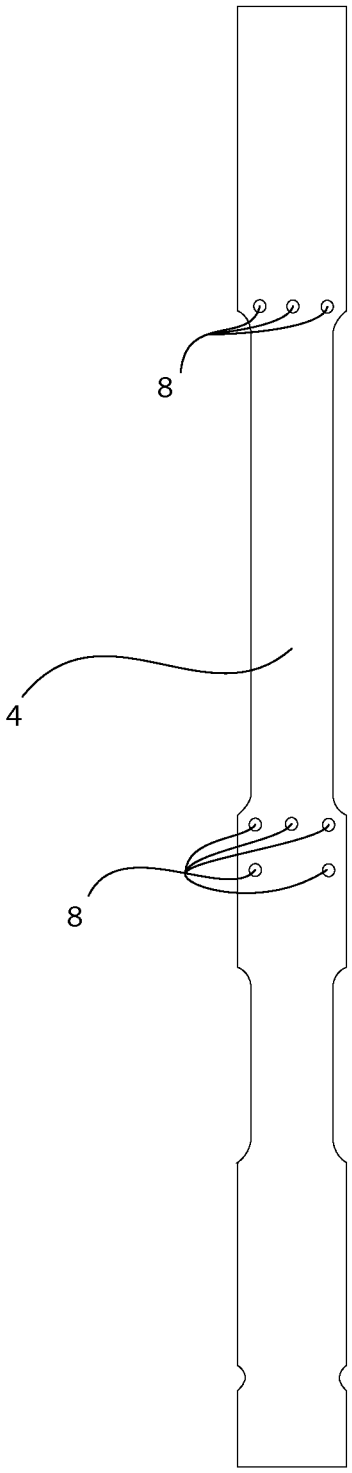
FIG. 6 is a front view of the main mounting strap.

Another embodiment of the present invention as shown in FIG. 5, allows the user to use the present invention with snowboards. In reference to FIG. 4, an accessory attachment 5 is shown. The accessory attachment 5 lets the present invention attach to snowboards and comprises a right flap 51, a left flap 52, a male fastening end 6, a female fastening 7, and a plurality of pop rivets 8. The right flap 51 and left flap 52 further comprise of a plurality of holes 53 for snowboard bindings to fit in. The male fastening end 6 is attached to the end of the right flap 51 and secured by the pop rivets 8 and the female fastening end 7 is attached to the end of the left flap 52 and is also secured by the pop rivets 8. The fastening ends on the flaps are then paired with the correct fastening ends on the main mounting strap 4, that is to say male fastening end 6 to female fastening end 7 and female fastening end 7 to male fastening end 6. When snowboard bindings are fitted in with the snowboard version of the invention, the flaps from the present invention are securely locked in. Again, when the user wants to perform or practice an ollie, the user jumps and at the same time exerts an upward pulling force on the handle, pulling the snowboard up with the user.

Figure 2:
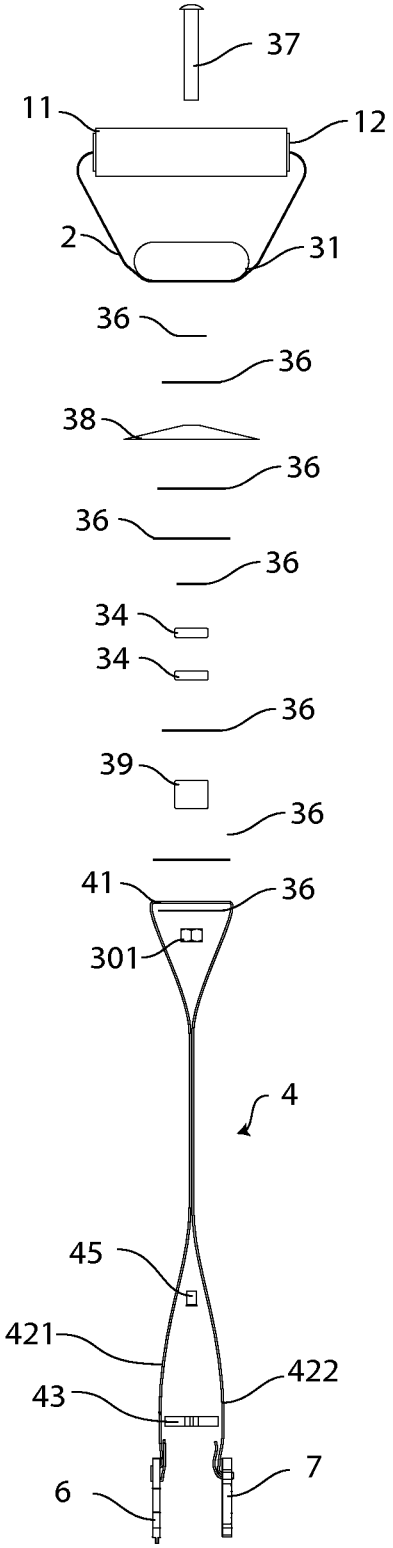
FIG. 2 is a front elevational exploded view of the present invention.
Figure 3:
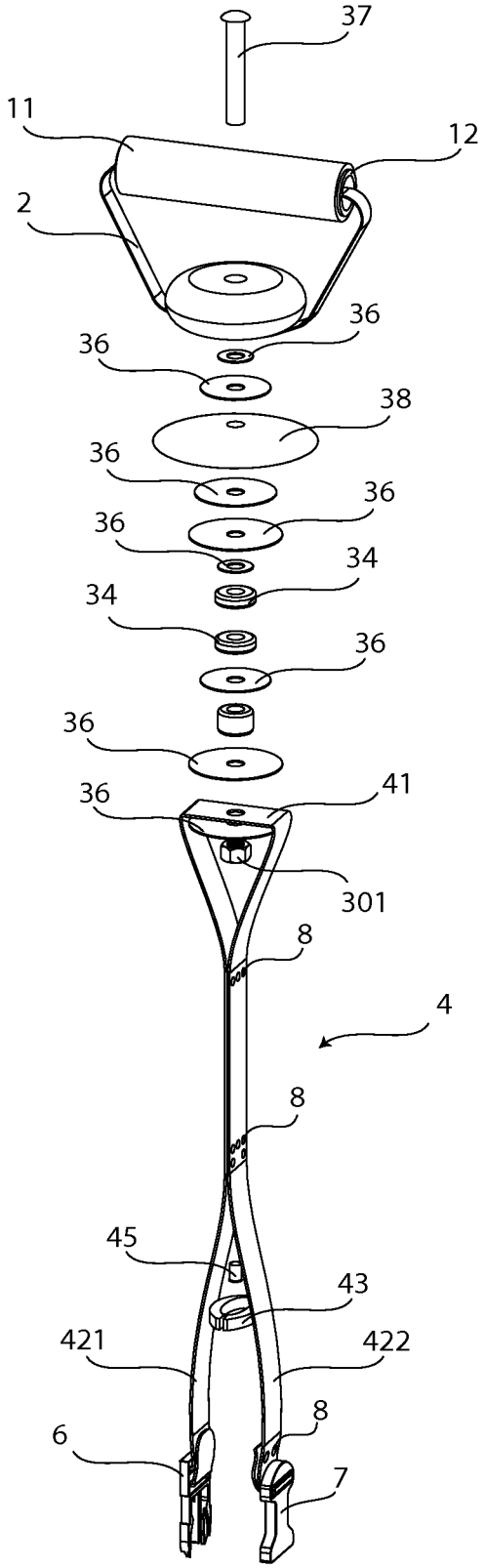
FIG. 3 is a perspective exploded view of the present invention.

Another embodiment of the present invention as referenced in FIG. 2 and FIG. 3. In this embodiment, the swivel connection is arranged differently from the preferred embodiment. The swivel connection in this case comprises a bolt 37, a plurality of washers 36, a hub cap 38, a bearing 34, a wheel 31, a plastic spacer 39, and a lug nut 301. From the figure, starting from the bolt 37, the assembly of the swivel connection 3 is arranged as this: a 2" to 2.5" bolt, a ¾"×⅜" rubber washer, a 1.5"×⅜" metal washer, the hub cap, a ¾"×⅜" rubber washer, a 2"×⅜" metal washer, ¾"×⅜" rubber washer, a ⅞"×⅜"×¼" thick bearing, another ⅞"×⅜"×¼" thick bearing, a 1.5"×⅜" metal washer, a plastic spacer, 2"×⅜" metal washer, another 2"×⅜" metal washer, and the lug nut 301.

The following are the steps for assembling the handle of the present invention:

Step 1—Insert plastic tube 12 into rubber grip 11.

Step 2—Cut main mounting strap 4 16 inches and place through plastic tube 12 and rubber grip 11.

Step 3—Screw main mounting strap 4 into bottom of wheel 31.

Step 4—Assemble the components of the swivel connection 3 above the wheel 31 in the following order:

1) Screw 32
2) 1½" by ⅜" Metal Washer
3) 2" by ⅜" Metal Washer
4) ¾" by ⅜" Rubber Washer
5) ¾" by ⅜" Metal Washer
6) ¾" by ⅜ " Metal Washer
7) ⅞" by ⅜" with ¼ thick bearing
8) ⅞" by ⅜" with ¼ thick bearing
9) Cap coupling 35

Step 5—Insert the assembly from Step 4 into wheel 31 and then assemble components below the wheel 31 in the following order:

1) ⅞" by ⅜" with ¼ thick bearing
2) ¾" by ⅜" Rubber Washer
3) 2" by ⅜" Metal Washer
4) Top of the looped end 41 of the main mounting strap 4
5) 2" by ⅜" Metal Washers
6) 1½" by ⅜" Metal Washer
7) Screw 32

Step 6—Insert the assembly from Step 5 onto the bottom wheel 31 and fasten into cap coupling 35.

Step 7—Glue main mounting strap 4 and leave 6 inches from the top of the strap and leave 8 inches from the bottom. Make sure main mounting strap 4 is even and straight for gluing. Keep pressed tightly for 24 hours.

Step 8—Fasten cap coupling 35 and securing band 43 to main mounting strap 4 by securing your main mounting strap 4 in place, at your 8" mark from the bottom using electric tape. Push the cap coupling 35 securely in tight, in between the main mounting strap 4. Then slip the securing band 43 carefully over the main mounting strap 4 and cap coupling 35 and fasten down tightly.

Step 9—Put three pop rivets 8 6 inches from the top of the main mounting strap 4 evenly spaced across. Second, then pop two pop rivets 8 at 10 inches from the bottom of the main mounting strap 4 tightly against the coupling 45 and band. Third, pop three more pop rivets 8 2 inches up from the securing band 43.

Step 10—cut off the spout of the main mounting strap 4, leaving the metal patch for support. Second, keeping the main mounting strap 4 pulled tight, cut bottom in half for fastening buckles.

Step 11—Measure from the bottom of the cap coupling 35 down 4.5" on both sides of the main mounting strap 4.

Step 12—Slip fastening buckles to measured out lines.

Step 13—Pop two pop rivets 8 on each side tightly up against fastening buckles.

The following are the steps for assembling the accessory attachment 5:

Step 1—Cut rubber into dimensions 4" in Width, by 12" in Length.

Step 2—Measure out dimensions to be cut for fastening buckle. Measure and drill three holes for snowboard bindings Step 3—Fold left flap across the bottom of the 2" flap, then fold right flap over left flap. (Slip flap through fastening buckle).

Step 4—Fold over the top of 2" flap an inch past the bottom of the cut. Place two pop rivets 8 through flap. Repeat process with the other flap.

Although the invention has been explained in relation to its preferred embodiment, it is to be understood that many other possible modifications and variations can be made without departing from the spirit and scope of the invention as hereinafter claimed.

What is claimed is:

1. A skate and snowboard training aid, comprising,
a handle;
a handle strap;
a swivel connection;
a main mounting strap;
the handle strap being longitudinally threaded through the handle;
the free ends of the handle strap being attached to the swivel connection;
the main mounting strap further comprising a looped end, a forked end, a plurality of pop rivets, a male fastening end, and a female fastening end;
the looped end of the main mounting strap being attached to the swivel connection;
the forked end of the main mounting strap further comprising a left end and a right end;
the male fastening end being attached and held securely in place by the pop rivets to the left end of the forked end; and
the female fastening end being attached and held securely in place by the pop rivets to the right end of the forked end.

2. The skate and snowboard training aid as claimed in claim 1, comprising,
the handle further comprising a rubber grip and a plastic tube; and
the plastic tube being inserted concentrically through the rubber grip.

3. The skate and snowboard training aid as claimed in claim 1, comprising,
the looped end being formed by fastening different parts of the main mounting strap to itself using the pop rivets.

4. The skate and snowboard training aid as claimed in claim 1, comprising,
the main mounting strap further comprising a securing band, and a cap coupling;
the cap coupling being placed in between the space between the base of the left end of the base of the right end; and
the securing band being wrapped around the base of the left end and the base of the right end and the cap coupling to hold them in place.

5. The skate and snowboard training aid as claimed in claim 1, comprising,
an accessory attachment to allow the present invention to be used with a snowboard.

6. The skate and snowboard training aid as claimed in claim 5, comprising,
the accessory attachment further comprising a right flap, a left flap, a male fastening end, a female fastening end, and additional pop rivets;
the right and left flap further comprising a plurality of holes to allow a snowboard to attach to the present invention;
the male fastening end being attached and held securely in place by the additional pop rivets to the right flap;
the female fastening end being attached and held securely in place by the additional pop rivets to the left flap; and
the accessory attachment being attached to the forked end by connecting the correct corresponding fastening ends.

7. A skate and snowboard training aid, comprising,
a handle;
a handle strap;
a swivel connection;
a main mounting strap;
an accessory attachment to allow the present invention to be used with a snowboard;
the handle strap being longitudinally threaded through the handle;
the free ends of the handle strap being attached to the swivel connection;
the main mounting strap further comprising a looped end, a forked end, a securing band, a cap coupling, a plurality of pop rivets, a male fastening end, and a female fastening end;
the looped end being formed by fastening different parts of the main mounting strap to itself using the pop rivets;
the looped end of the main mounting strap being attached to the swivel connection;
the forked end of the main mounting strap further comprising a left end and a right end;
the male fastening end being attached and held securely in place by the pop rivets to the left end of the forked end;
the female fastening end being attached and held securely in place by the pop rivets to the right end of the forked end;
the cap coupling being placed in between the space between the base of the left end of the base of the right end; and
the securing band being wrapped around the base of the left end and the base of the right end and the cap coupling to hold them in place.

8. The skate and snowboard training aid as claimed in claim 7, comprising,
the handle further comprises a rubber grip and a plastic tube; and
the plastic tube being inserted concentrically through the rubber grip.

9. The skate and snowboard training aid as claimed in claim 7, comprising,
the accessory attachment further comprising a right flap, a left flap, a male fastening end, a female fastening end, and additional pop rivets;
the right and left flap further comprising a plurality of holes to allow a snowboard to attach to the present invention;
the male fastening end being attached and held securely in place by the additional pop rivets to the right flap;
the female fastening end being attached and held securely in place by the additional pop rivets to the left flap; and
the accessory attachment being attached to the forked end by connecting the correct corresponding fastening ends.

10. A skate and snowboard training aid, comprising,
a handle;
a handle strap;

a swivel connection;

a main mounting strap;

an accessory attachment to allow the present invention to be used with a snowboard;

the handle further comprises a rubber grip and a plastic tube;

the plastic tube being inserted concentrically through the rubber grip;

the handle strap being longitudinally threaded through the handle;

the free ends of the handle strap being attached to the swivel connection;

the main mounting strap further comprising a looped end, a forked end, a securing band, a cap coupling, a plurality of pop rivets, a male fastening end, and a female fastening end;

the looped end being formed by fastening different parts of the main mounting strap to itself using the pop rivets;

the looped end of the main mounting strap being attached to the swivel connection;

the forked end of the main mounting strap further comprising a left end and a right end;

the male fastening end being attached and held securely in place by the pop rivets to the left end of the forked end;

the female fastening end being attached and held securely in place by the pop rivets to the right end of the forked end;

the cap coupling being placed in between the space between the base of the left end of the base of the right end;

the securing band being wrapped around the base of the left end and the base of the right end and the cap coupling to hold them in place;

the accessory attachment further comprising a right flap, a left flap, a male fastening end, a female fastening end, and additional pop rivets;

the right and left flap further comprising a plurality of holes to allow a snowboard to attach to the present invention;

the male fastening end being attached and held securely in place by the additional pop rivets to the right flap;

the female fastening end being attached and held securely in place by the additional pop rivets to the left flap; and the accessory attachment being attached to the forked end by connecting the correct corresponding fastening ends.

* * * * *